US011510500B1

(12) United States Patent
Harris

(10) Patent No.: US 11,510,500 B1
(45) Date of Patent: Nov. 29, 2022

(54) FOLDABLE LEARNING TOWER WITH A HEIGHT-ADJUSTABLE PLATFORM

(71) Applicant: Graig Harris, San Diego, CA (US)

(72) Inventor: Graig Harris, San Diego, CA (US)

( * ) Notice: Subject to any disclaimer, the term of this patent is extended or adjusted under 35 U.S.C. 154(b) by 58 days.

(21) Appl. No.: 17/342,482

(22) Filed: Jun. 8, 2021

(51) Int. Cl.
*A47C 12/00* (2006.01)
*A47C 13/00* (2006.01)
*A47D 13/00* (2006.01)

(52) U.S. Cl.
CPC ..... *A47C 12/00* (2013.01); *A47D 13/00* (2013.01)

(58) Field of Classification Search
CPC .... A47C 4/04; A47C 3/20; A47C 3/26; A47C 7/402; A47C 7/407; A47C 12/00; A47C 13/00
USPC ..... 297/440.1, 440.14, 440.15, 59, 29
See application file for complete search history.

(56) References Cited

U.S. PATENT DOCUMENTS 668,038 A * 2/1901 Duhamel ..... B01D 53/68 423/240 R
2,518,425 A * 8/1950 Kahn ..... A47D 1/004 297/338
3,948,192 A * 4/1976 Yellin ..... A47B 47/05 182/228.1
4,290,502 A * 9/1981 Anderson ..... A47C 12/02 182/125
6,817,046 B1 * 11/2004 Srour ..... A47D 13/065 5/100
8,045,691 B2 10/2011 Hines
8,479,328 B2 * 7/2013 Srour ..... A47D 7/03 5/93.1
9,949,566 B1 * 4/2018 Thiel, III ..... A47C 4/04

OTHER PUBLICATIONS

U.S. Appl. No. 16/623,776, filed Jun. 22, 2021, Gullick.

* cited by examiner

*Primary Examiner* — Sarah B McPartlin
(74) *Attorney, Agent, or Firm* — Eric Hanscom

(57) ABSTRACT

The learning tower includes a frame and a platform. The frame includes a rear leg assembly and a front leg assembly rotatably coupled to one another. The platform is removably coupled to the frame. The learning tower is configured to transition between an open position and a closed position, and the platform is configured to transition between a lower position and an upper position. In the lower position, the first end of the platform is rotatably coupled to the frame at a lower mounting position and the second end of the platform is slidably coupled to the frame through engagement with a first pair of channels. In the upper position, the first end of the platform is rotatably coupled to the frame at an upper mounting position and the second end of the platform is slidably coupled to the frame through engagement with a second pair of channels.

11 Claims, 5 Drawing Sheets

FOLDABLE LEARNING TOWER WITH A HEIGHT-ADJUSTABLE PLATFORM

CROSS-REFERENCE TO RELATED APPLICATION(S)

Not applicable.

BACKGROUND OF THE INVENTION

1. Field of Invention

This invention relates to learning towers for children. More specifically, this invention relates to foldable learning towers with height-adjustable platforms.

2. Description of Related Art

Learning towers provide a creative and safe way to elevate young children to counter height to expand their level of engagement. Unlike highchairs and similar devices that restrain children in a seated position, learning towers allow children to come and go as they please, giving them a greater sense of freedom. In an effort to accommodate growing children and varying countertop heights, a number of learning towers have been designed with a height-adjustable platform. For example, US20200345154A1 discloses pairs of slots in the side walls for receiving the platform, the slots being disposed at various heights, thereby allowing the user to adjust the height of the platform, as needed. Similarly, DE202020106604U1 and DE202018000719U1 disclose pairs of horizontal grooves in the side parts for receiving the edges of the platform, the grooves being disposed at various heights, thereby allowing the user to adjust the height of the platform, as needed. While useful, a major disadvantage inherent with these types of learning towers is their fixed-frame design, making them difficult to transport and stow away.

Foldable learning towers are much more user- and space-friendly than their fixed-frame counterparts. However, a major disadvantage to most foldable learning towers is the inability to adjust the height of the platform. Currently, learning towers that are both height-adjustable and foldable employ a dual-action folding design, whereby the platform is engaged with only one pair of legs, e.g., the rear legs. The process of setting up a dual-action tower begins with the user opening the legs. Once the legs are open, the user then engages the platform with a support member extending between the front legs. Contrarywise, collapsing the tower begins with disengaging the platform from the support member and raising or lowering the platform into place along the rear legs. Once the platform is in place, the legs can be closed.

Based on the foregoing, there is a need in the art for a foldable learning tower with a height-adjustable platform, whereby the tower can be deployed into an active position or collapsed into a storage position in a single action.

SUMMARY OF THE INVENTION

According to an embodiment, the learning tower includes a frame and a platform. The frame includes a rear leg assembly rotatably coupled to a front leg assembly. A first end and a second end of the platform are removably coupled to the frame. The learning tower is configured to transition between an open position and a closed position, and the platform is configured to transition between a lower position and an upper position. In the lower position, the first end of the platform is rotatably coupled to the frame at a lower mounting position and the second end of the platform is slidably coupled to the frame through engagement with a first pair of channels. In the upper position, the first end of the platform is rotatably coupled to the frame at an upper mounting position and the second end of the platform is slidably coupled to the frame through engagement with a second pair of channels. In an embodiment, each channel of the first pair of channels is interconnected with a channel of the second pair of channels.

In an embodiment, the first end of the platform is coupled to the rear leg assembly and the second end of the of the platform is coupled to the front leg assembly. In an embodiment, one or more support members are removably coupled to the front leg assembly. The support member(s) are configured to support the second end of the platform when the learning tower is in the open position. When the platform is in the lower position, the support member(s) are disposed at a first mounting position. When the platform is in the upper position, the support member(s) are disposed at a second mounting position.

In an embodiment, the first end of the platform is coupled to the front leg assembly and the second end of the of the platform is coupled to the rear leg assembly. In an embodiment, one or more support members are removably coupled to the rear leg assembly. The support member(s) are configured to support the first end of the platform when the learning tower is in the open position. When the platform is in the lower position, the support member(s) are disposed at a first mounting position. When the platform is in the upper position, the support member(s) are disposed at a second mounting position.

Application of upward force to the second end of the platform is configured to transition the learning tower from the open position to the closed position, and application of downward force to the second end of the platform is configured to transition the learning tower from the closed position to the open position.

In an embodiment, a guardrail is rotatably coupled to the frame, wherein the guardrail is configured to transition between a storage position and an active position. In an embodiment, the guardrail rotates about a common axis of rotation with the front leg assembly and the rear leg assembly.

In an embodiment, at least one leg of the frame includes a C-shaped channel. A stop is configured to pass through an aperture in the guardrail and into the C-shaped channel, wherein a portion of the stop is configured to travel within the C-shaped channel as the guardrail is rotated.

In various embodiments, at least one leg of the frame includes one or more receivers configured to receive a distal portion of the stop. In an embodiment, when the learning tower is in the open position and the guardrail is in the active position, an aperture in the C-shaped channel axially aligns with the guardrail aperture and a receiver, wherein the stop is configured to pass through the guardrail aperture and the C-shaped channel aperture and into the receiver to temporarily lock the learning tower in the open position and the guardrail in the active position. In an embodiment, when the learning tower is in the closed position and the guardrail is in the storage position, an aperture in the C-shaped channel axially aligns with the guardrail aperture and a receiver, wherein the stop is configured to pass through the guardrail aperture and the C-shaped channel aperture and into the receiver to temporarily lock the learning tower in the closed position and the guardrail in the storage position.

The foregoing, and other features and advantages of the invention, will be apparent from the following, more particular description of the preferred embodiments of the invention, the accompanying drawings, and the claims.

BRIEF DESCRIPTION OF THE DRAWINGS

For a more complete understanding of the present invention, the objects and advantages thereof, reference is now made to the ensuing descriptions taken in connection with the accompanying drawings briefly described as follows.

DETAILED DESCRIPTION OF PREFERRED EMBODIMENTS

Figure 1:
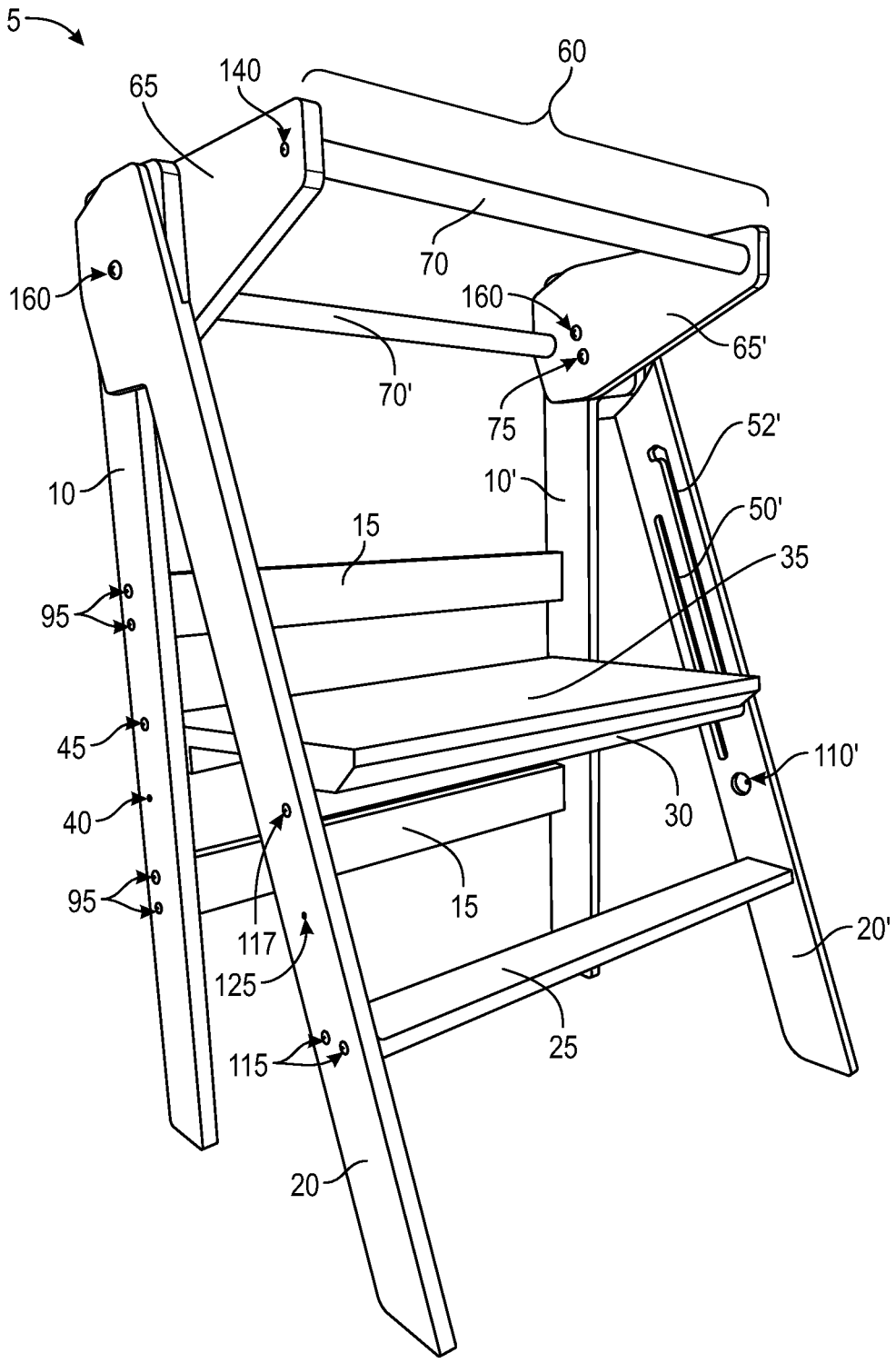
FIG. 1 shows the learning tower in an open position, according to an embodiment of the present invention.

In the following detailed description, reference is made to the accompanying drawings which form a part hereof, and in which are shown by way of illustration embodiments that may be practiced. It is to be understood that other embodiments may be utilized and structural or logical changes may be made without departing from the scope. Therefore, the following detailed description is not to be taken in a limiting sense, and the scope of embodiments is defined by the appended claims and their equivalents.

Various operations may be described as multiple discrete operations in turn, in a manner that may be helpful in understanding embodiments; however, the order of description should not be construed to imply that these operations are order-dependent.

The description may use perspective-based descriptions such as up/down, back/front, left/right, and top/bottom. Such descriptions are merely used to facilitate the discussion and are not intended to restrict the application of disclosed embodiments.

The terms "coupled" and "connected," along with their derivatives, may be used. It should be understood that these terms are not intended as synonyms for each other. Rather, in particular embodiments, "connected" may be used to indicate that two or more elements are in direct physical contact with each other. "Coupled" may mean that two or more elements are in direct physical contact. However, "coupled" may also mean that two or more elements are not in direct contact with each other, but yet still cooperate or interact with each other.

For the purposes of the description, a phrase in the form "A/B" or in the form "A and/or B" means (A), (B), or (A and B). For the purposes of the description, a phrase in the form "at least one of A, B, and C" means (A), (B), (C), (A and B), (A and C), (B and C), or (A, B and C). For the purposes of the description, a phrase in the form "(A)B" means (B) or (AB) that is, A is an optional element.

The description may use the terms "embodiment" or "embodiments," which may each refer to one or more of the same or different embodiments. Furthermore, the terms "comprising," "including," "having," and the like, as used with respect to embodiments, are synonymous.

Preferred embodiments of the present invention and their advantages may be understood by referring to FIGS. 1-5B, wherein like reference numerals refer to like elements.

Figure 2:
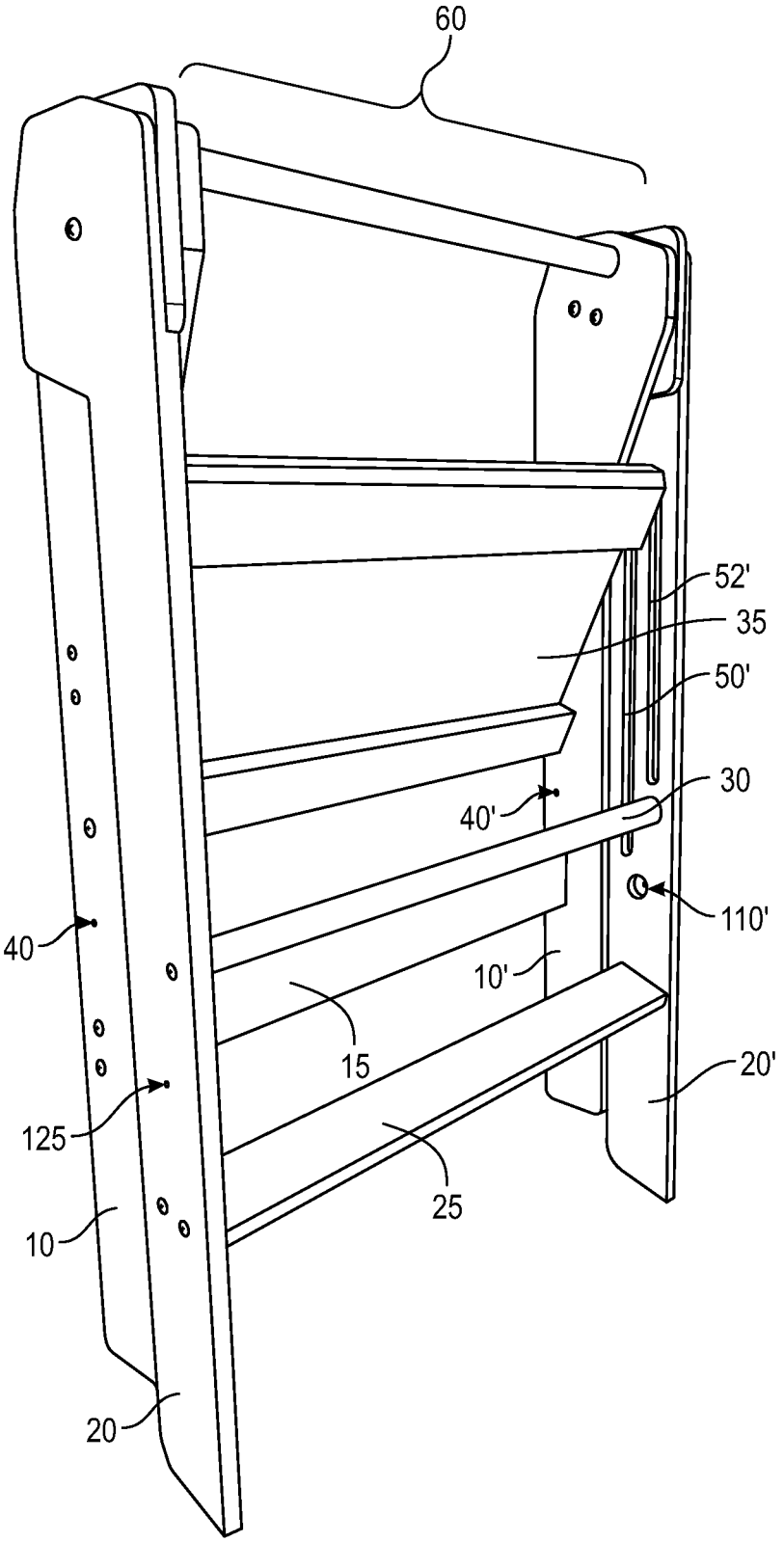
FIG. 2 shows the learning tower in a closed position, according to an embodiment of the present invention.

With reference to FIG. 1, learning tower 5 includes a frame comprised of a rear leg assembly and a front leg assembly. The rear leg assembly includes rear legs 10, 10' and cross braces 15. The front leg assembly includes front legs 20, 20', step 25, and, optionally, support member 30. In an embodiment, legs 10, 10' are mirror images of one another, and legs 20, 20' are mirror images of one another. In an assembled state, the upper ends of legs 10, 20 and, likewise, the upper ends of legs 10', 20' are rotatably coupled to one another, whereby the front leg assembly and the rear leg assembly rotate relative to one another about a common axis to facilitate the process of transitioning learning tower 5 between an open, i.e., active, position, as shown in FIG. 1, to a closed, i.e., storage, position, as shown in FIG. 2. In a preferred embodiment, rear legs 10, 10' are perpendicular to a floor surface when learning tower 5 is in the open position.

Platform 35 is disposed between rear legs 10, 10' and front legs 20, 20'. With reference to FIGS. 1-2 & 4A-4B, rear leg 10 includes vertically-staggered apertures 40, 42, and rear leg 10' includes vertically-staggered apertures 40', 42' that correspond with apertures 40, 42, respectively. Apertures 40, 40', 42, 42' facilitate coupling platform 35 with legs 10, 10'. In an embodiment, nonpermanent fasteners 45, e.g., a bolt, or other similar fastener, is removably coupled to each side of the rear portion of platform 35 through aperture 40 or 42 in rear leg 10 and the corresponding aperture 40', 42' in rear leg 10'. Alternatively, with reference to FIG. 5B, the rear portion of platform 35 may include spring-loaded bolt latches 37, wherein one bolt is configured to pass into aperture 40 or 42 of leg 10, and the other bolt is configured to pass into the corresponding aperture 40', 42' in leg 10' to couple platform 35 to legs 10, 10'. Using spring-loaded bolt latches 37 provides a tool-less alternative to using fasteners 45.

While the foregoing contemplates specific means for removably and rotatably coupling platform 35 to legs 10, 10', means for removably and rotatably coupling one component to another are known to those skilled in the art and can be embodied in a number of ways other than that as described and illustrated. As such, other means for removably and rotatably coupling platform 35 to the frame could be employed with the present invention without deviating from the scope of the invention.

With reference to FIGS. 1-3B, front leg 20 includes channels 50, 52, and front leg 20' includes channels 50', 52' that correspond with channels 50, 52, respectively. Channels 50, 50', 52, 52' facilitate coupling a forward portion of platform 35 with legs 20, 20'. In an embodiment, as shown in the figures, channels 50, 50', 52, 52' are cut into the interior surface of legs 20, 20', i.e., they do not extend through legs 20, 20'. In another embodiment, channels 50, 50', 52, 52' extend through legs 20, 20'. In an embodiment, as shown in the figures, channels 50, 52 and, likewise, channels 50', 52', are disposed parallel to one another and are vertically and horizontally offset from one another. In an embodiment, channels 50, 52 and, likewise, channels 50', 52' may be interconnected to facilitate transitioning between the channels. For example, channels 50, 52 and, likewise, channels 50', 52' may be configured such that the end of one channel, e.g., channel 50, terminates into the other channel, e.g., channel 52. As another example, channels 50, 52 and, likewise, channels 50', 52' may be configured in an H-shape, whereby they are linked at a point between their ends.

Figure 5A:
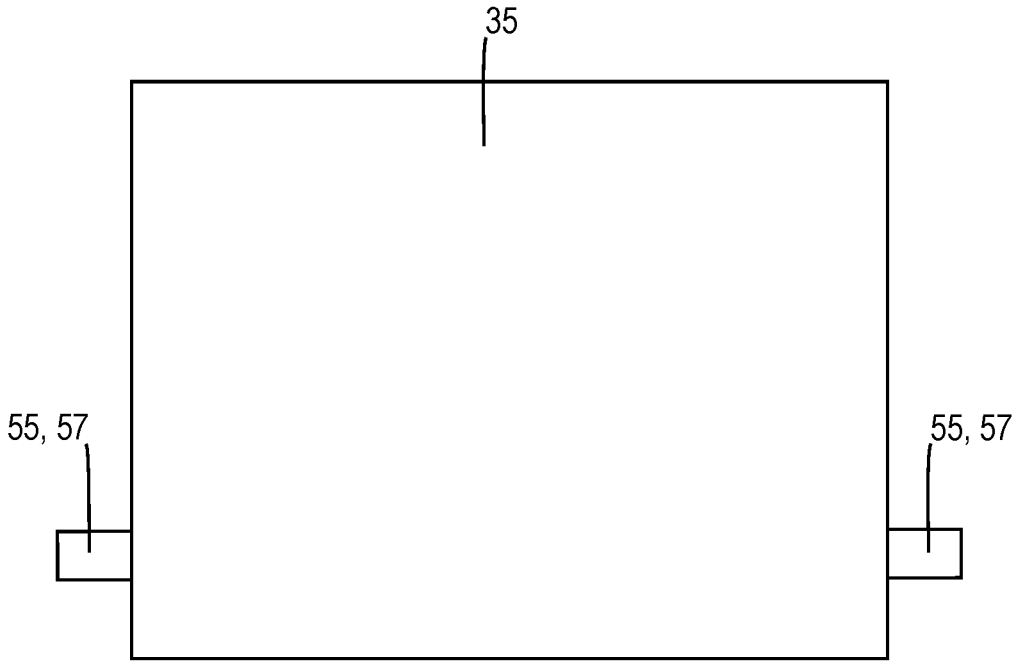
FIGS. 5A-5B show the platform of the learning tower, according to various embodiment of the present invention.
Figure 5B:
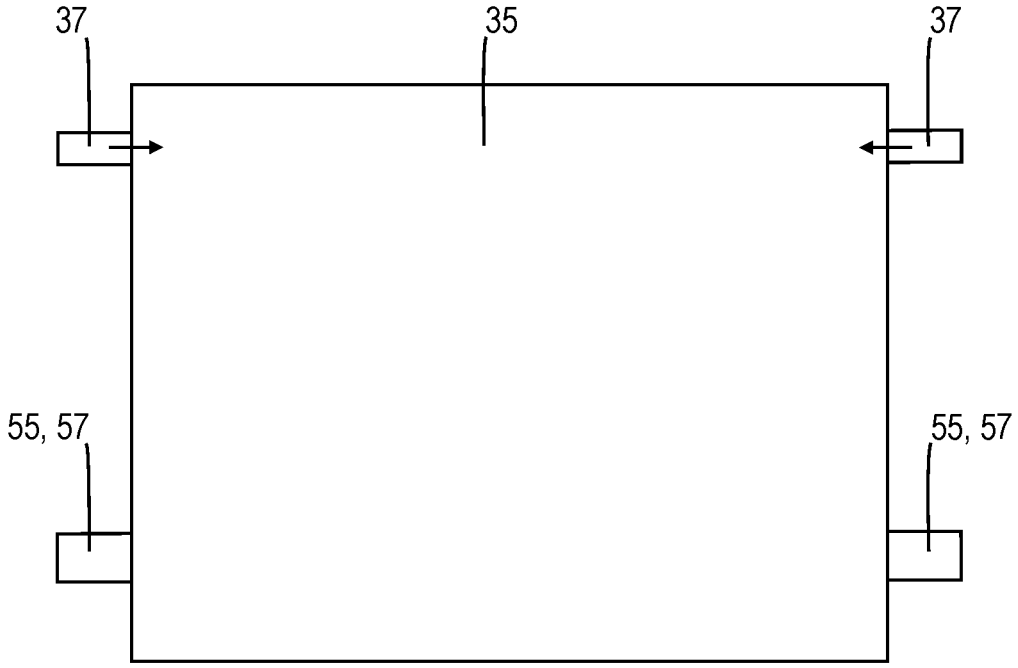

With reference to FIGS. 5A-5B, couplers 55, 57 are used to facilitate coupling platform 35 with legs 20, 20'. In an embodiment, coupler 55 is a single rod (or rod-like structure), wherein the length of coupler 55 is greater than the width of platform 35, such that the ends of coupler 55 protrude from the sides of platform 35. Alternatively, two separate couplers 57, e.g., peg-type dowels, bolts, etc., may be coupled to opposite sides of platform 35.

With reference to FIG. 1, cross braces 15 are used to provide structural support to a rear portion of the frame, whereby a first end of each cross brace 15 is connected to leg 10 and a second end of each cross brace 15 is connected to leg 10'. Structural support elements, such as cross brace 15, are known to those skilled in the art and can be embodied in a number of ways other than that as illustrated. As such, other types or configurations of cross braces (other than those shown) could be employed with the present invention without deviating from the scope of the invention.

Support member 30 supports the front end of platform 35 when learning tower 5 is in the open position. In an embodiment, a first end of support member 30 is connected to leg 20 and a second end of support member 30 is connected to leg 20'. Thus, in addition to supporting platform 35, support member 30 provides structural support to a forward portion of the frame. In an embodiment, opposing support members (not shown) attached to legs 20, 20' may be used in lieu of support member 30, whereby one support member supports one side of the forward portion of platform 35 and the opposing support member supports the opposite side of the forward portion of platform 35.

In an embodiment, support member 30 may be eliminated. In such an embodiment, when learning tower 5 is in the open position with coupler(s) 55, 57 positioned at a lower end of channels 50, 50', 52, 52', coupler(s) 55, 57 support the forward end of platform 35. In such an embodiment, the material composition and dimensional aspects of coupler(s) 55, 57 would be appropriately selected to withstand the forces exerted onto platform 35 when in use.

Guardrail 60 is rotatably coupled to the top portion of the frame. Guardrail 60 includes siderails 65, 65', separated by forward and rearward safety bars 70, 70'. In an embodiment, siderails 65, 65' are mirror images of one another. Guardrail 60 rotates about the same axis of rotation as legs 10, 10', 20, 20', whereby guardrail 60 is configured to transition between an active position, as shown in FIG. 1, to a storage position, as shown in FIG. 2. In an embodiment, stops 75, e.g., a bolt, etc., having a rod-shaped shaft, are removably coupled, e.g., by threaded engagement, friction fit, etc., to siderails 65, 65' through off-center apertures (not shown). Stops 75 pass through siderails' off-center apertures and into c-shaped channels 85, 85' in legs 10, 10'. Guardrail 60 is able to rotate in either direction, i.e., forward or backward, until stops 75 reach the end of channels 85, 85'. Thus, the degree of rotation of guardrail 60 is dependent on the length of channels 85, 85'.

Figure 3A:
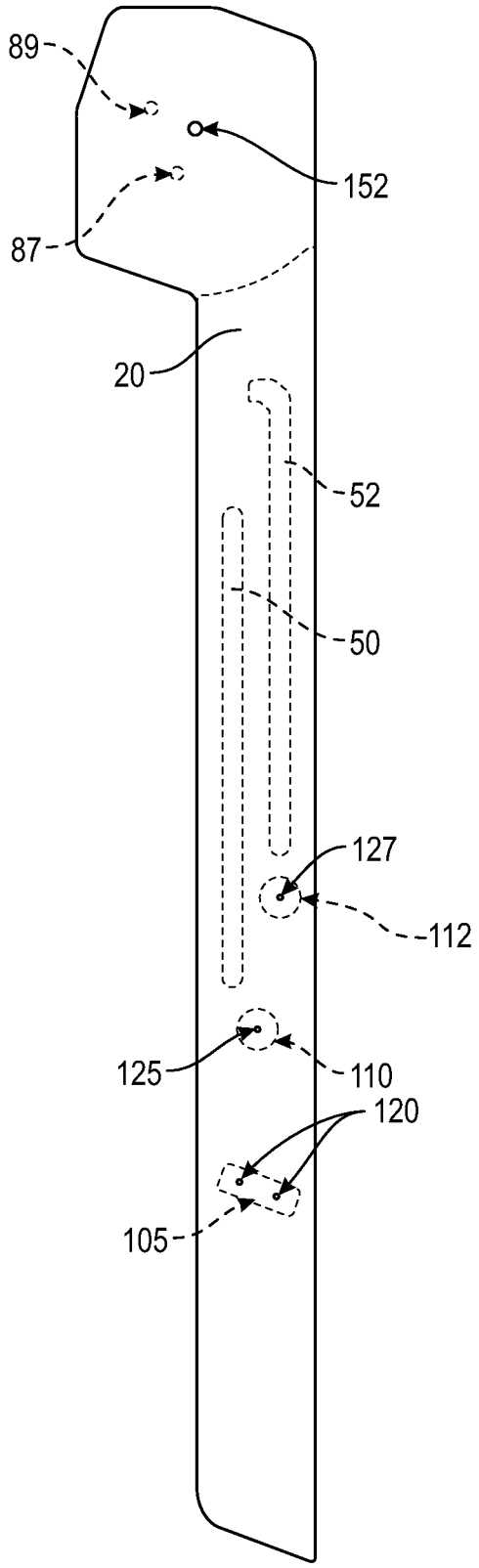
FIGS. 3A-3B show the front legs of the learning tower, according to an embodiment of the present invention. The evenly-spaced broken lines in FIG. 3A are used to show features disposed at the opposite side of the leg shown in FIG. 3A.
Figure 3B:
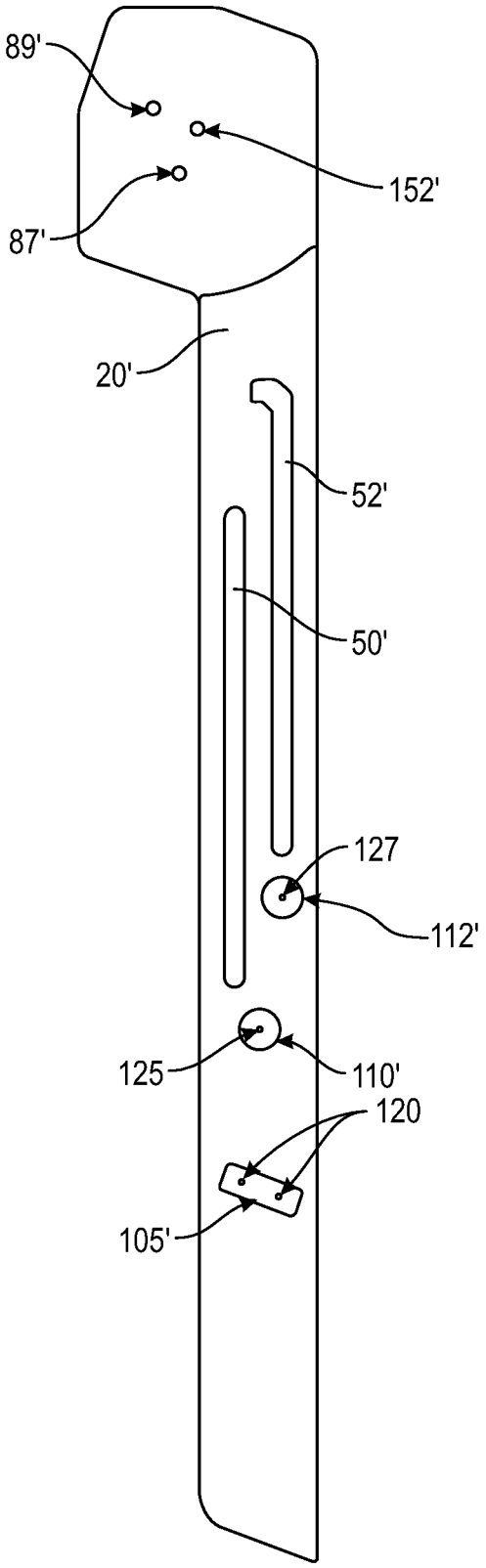

With reference to FIGS. 3A-3B, in an embodiment, apertures 86, 86' extend through legs 10, 10' at the lower end of channels 85, 85'. Receivers 87, 87' extend into legs 20, 20'. When learning tower 5 is in the open position and guardrail 60 is in the active position, siderails' off-center apertures and apertures 86, 86' align with receivers 87, 87'. Receivers 87, 87' are configured to receive a distal portion of stops 75 to temporarily lock learning tower 5 in the open position and guardrail 60 in the active position. Once stops 75 are retracted from receivers 87, 87', such that the distal end of stops 75 are disposed within channels 85, 85', learning tower 5 and guardrail 60 can transition to their closed/storage positions.

In an embodiment, apertures 88, 88' extend through legs 10, 10' at the upper end of channels 85, 85'. Receivers 89, 89' extend into legs 20, 20'. When learning tower 5 is in the closed position and guardrail 60 is in the storage position, siderails' off-center apertures and apertures 88, 88' align with receivers 89, 89'. Receivers 89, 89' are configured to receive a distal portion of stops 75 to temporarily lock learning tower 5 in the closed position and guardrail 60 in the storage position. Once stops 75 are retracted from receivers 89, 89', such that the distal end of stops 75 are disposed within channels 85, 85', learning tower 5 and guardrail 60 can transition to their open/active positions.

While the drawings show legs 20, 20' coupled to the outside of legs 10, 10', one skilled in the art would understand that the invention could be constructed with legs 10, 10' coupled to the outside of legs 20, 20'. In such an embodiment, the elements of the tops of legs 10, 10', as shown and described, would be replaced by the elements of legs 20, 20', as shown and described, respectively, and vice versa. For example, legs 20, 20' would include channels 85, 85' and apertures 86, 86', 88, 88', 150, 150', and legs 10, 10' would include apertures 152, 152' and receivers 87, 87', 89, 89'.

In an embodiment, the placement of apertures 40, 40', 42, 42' and channels 50, 50', 52, 52' is reversed, i.e., apertures 40, 40', 42, 42' are disposed through legs 20, 20' and channels 50, 50', 52, 52' are disposed in/through legs 10, 10'. In such an embodiment, the orientation of platform 35 is reversed, whereby coupler(s) 55, 57 are used to couple platform 35 to legs 10, 10' and fasteners 45, spring-loaded bolt latches 37, etc. are used to couple platform 35 to legs 20, 20'. Additionally, if used, support member 30 (or alternative support member(s)) would be coupled to legs 10, 10' to support the rear portion of platform 35 when learning tower 5 is in the open position. Alternatively, a cross brace 15 (coupled to legs 10, 10') may be configured/positioned to serve as an alternative support member (in lieu of support member 30) for supporting the rear portion of platform 35 when learning tower 5 is in the open position.

Method of Assembly

In order to aid in the understanding of the components of the present invention, and how they interact, an example will now be given of how one embodiment of a learning tower in accordance with the present invention is assembled. The following method of assembly is for illustrative purposes and should not be interpreted as being limiting.

Figure 4A:
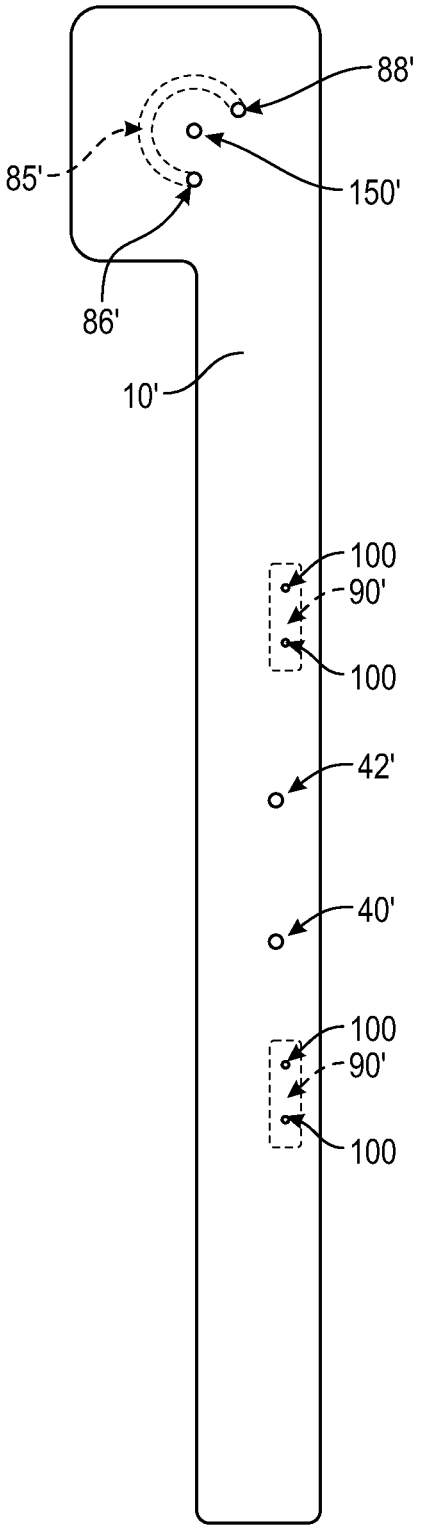
FIGS. 4A-4B show the rear legs of the learning tower, according to an embodiment of the present invention. The evenly-spaced broken lines in FIG. 4A are used to show features disposed at the opposite side of the leg shown in FIG. 4A.
Figure 4B:
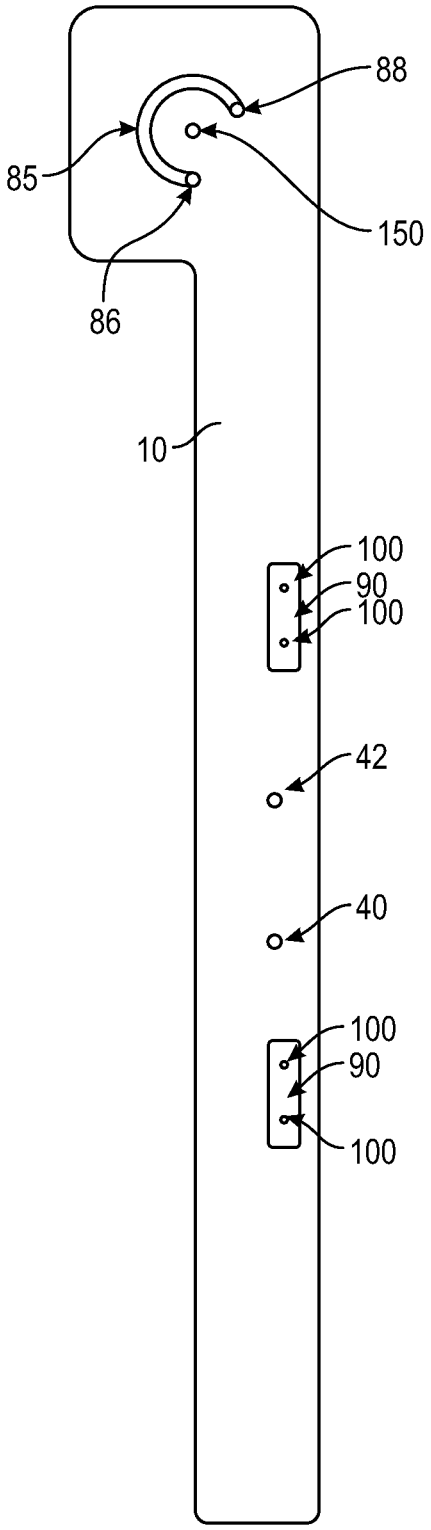

A method of assembling learning tower 5 begins with assembling the rear leg assembly, the front leg assembly, and guardrail 60. With reference to FIGS. 1 and 4A-4B the rear leg assembly is assembled by attaching cross braces 15 to rear legs 10, 10'. Each cross brace 15 is seated into corresponding mortises 90, 90' on the interior surface of legs 10, 10'. Once cross braces 15 are properly seated, releasable fasteners 95, e.g., screws, bolts, etc. are inserted through pre-drilled holes 100 in legs 10, 10' and into the ends of cross braces 15 to anchor cross braces 15 to rear legs 10, 10'.

With reference to FIGS. 1 and 3A-3B, the front leg assembly is assembled by attaching step 25 and, optionally, support member 30 (or alternative support member(s)), to front legs 20, 20'. Step 25 is seated into the corresponding mortises 105, 105' on the interior surface of legs 20, 20'. If used, support member 30 (or alternative support member(s))

is seated into corresponding mortises 110, 110' or 112, 112'. Once step 15 (and support member 30 (or alternative support member(s)), if used) is/are properly seated, releasable fasteners 115, 117, e.g., screws, bolts, etc. are inserted through pre-drilled holes 120 and 125 or 127 in legs 20, 20' and into the ends of step 25 (and support member 30 (or alternative support member(s)), if used) to anchor step 25 (and support member 30 (or alternative support member(s)), if used) to front legs 20, 20'.

With reference to FIG. 1, guardrail 60 is assembled by attaching safety bars 70, 70' to siderails 65, 65'. Safety bars 70, 70' are seated into the corresponding mortises (not shown) on the interior surfaces of siderails 65, 65'. Once safety bars 70, 70' are properly seated, releasable fasteners 140, e.g., screws, bolts, etc. are inserted through pre-drilled holes (not shown) in siderails 65, 65' and into the ends of safety bars 70, 70' to anchor safety bars 70, 70' to siderails 65, 65'.

Once the rear leg assembly, the front leg assembly, and guardrail 60 are assembled, the rear leg assembly and the front leg assembly are situated such that central apertures 150, 150', 152, 152' at the upper ends of legs 10, 10', 20, 20' are all axially aligned. Once aligned, guardrail 60 is positioned between legs 10, 20 and legs 10', 20' with central apertures 150, 150', 152, 152' axially aligned with siderails' central apertures (not shown), making certain that siderails' off-center apertures are positioned below siderails' central apertures (when legs 10, 10', 20, 20' are in an upright position). Once the rear leg assembly, the front leg assembly, and guardrail 60 are aligned, nonpermanent fasteners 160, e.g., double-headed bolts, are inserted into central apertures 150, 150', 152, 152' and siderails' central apertures and tightened to releasably couple the rear leg assembly, the front leg assembly, and guardrail 60.

Next, with learning tower 5 in the open position, guardrail 60 is rotated upward to an upright position. With safety bar 70 positioned above safety bar 70', stops 75 are inserted into siderails' off-center apertures so that the distal ends of stops 75 pass through siderails' off-center apertures and into channels 85, 85'.

Next, the forward portion of platform 35 is coupled to legs 20, 20' by inserting couplers 55, 57 into corresponding channels 50, 50' or 52, 52'.

Finally, the rearward portion of platform 35 is coupled to legs 10, 10' by inserting releasable fasteners 45 through corresponding apertures 40, 40' or 42, 42' in legs 10, 10' and into pre-drilled holes (not shown) in the rear portion of platform 35. Alternatively, if platform 35 includes spring-loaded bolt latches 37, with bolts in the retracted position, one bolt is aligned with aperture 40, 42 of leg 10 and the other bolt is aligned with the corresponding aperture 40', 42' in leg 10'. Once aligned, the bolts are allowed to transition to their locked/latched position and pass into apertures 40, 40' or 42, 42' to couple platform 35 to legs 10, 10'.

Method of Use

In order to aid in the understanding of the mechanics of the present invention, an example will now be given of how one embodiment of a learning tower in accordance with the present invention is used. The following method of use is for illustrative purposes and should not be interpreted as being limiting.

Once assembled, learning tower 5 is configured to transition between an open, i.e., active, position, as shown in FIG. 1, to a closed, i.e., storage, position, as shown in FIG. 2. In the open position, platform 35 is positioned horizontally; whereas, in the closed position, platform is positioned vertically. For embodiments that include receivers 87, 87', prior to transitioning learning tower 5 from the open position to the closed position, stops 75 must be retracted from receivers 87, 87', such that the distal end of stops 75 are disposed within channels 85, 85'. Once stops 75 are retracted from receivers 87, 87', the user lifts the front edge of platform 35. As platform 35 is lifted, it rotates about the axis created by releasable fasteners 45 (or spring-loaded bolt latches 37) toward the rear leg assembly. As platform 35 rotates upward, coupler(s) 55, 57 slide within channels 50, 50' or 52, 52', causing the front leg assembly and the rear leg assembly to move toward one another. Once the front leg assembly is closed onto/against the rear leg assembly, safety bar 70 is lifted, whereby guardrail 60 rotates about the axis created by nonpermanent fasteners 160 toward the rear leg assembly and tucks in between the front and rear leg assemblies in its storage position, as shown in FIG. 2. With reference to FIGS. 1 and 3A-3B, in an embodiment, the upper ends of channels 52, 52' are hooked to allow coupler(s) 55, 57 to move further inward in the closed position. This allows platform 35 to stow fully in between the front and rear leg assemblies in the closed position. For embodiments that include receivers 89, 89', once guardrail 60 is in its storage position, as shown in FIG. 2, stops 75 are advanced into receivers 89, 89' to lock learning tower 5 in the closed position and guardrail 60 in the storage position.

In an embodiment, wherein apertures 40, 40', 42, 42' are disposed through legs 20, 20' and channels 50, 50', 52, 52' are disposed in/through legs 10, 10', with stops 75 retracted from receivers 87, 87' (so that the distal end of stops 75 are disposed within channels 85, 85'), the user lift up on the rear edge of platform 35 to transition learning tower 5 from the open position to the closed position. As platform 35 is lifted, it rotates about the axis created by releasable fasteners 45 (or spring-loaded bolt latches 37) toward the front leg assembly. As platform 35 rotates upward, couplers 55, 57 slide within channels 50, 50' or 52, 52', thereby causing the rear leg assembly and the front leg assembly to move toward one another. Once the front leg assembly is closed onto/against the rear leg assembly, guardrail 60 is stowed away in the storage position as described above.

To transition learning tower 5 from the closed position to the open position, the user must exert downward force, e.g., by pulling or pushing, on the front edge of platform 35. For embodiments that include receivers 89, 89', prior to transitioning learning tower 5 from the closed position to the open position, stops 75 must be retracted from receivers 89, 89', such that the distal end of stops 75 are disposed within channels 85, 85'. With stops 75 retracted from receivers 89, 89', platform 35 rotates downward about the axis created by releasable fasteners 45 (or spring-loaded bolt latches 37) away from the rear leg assembly. As platform 35 rotates downward, coupler(s) 55, 57 slide within channels 50, 50' or 52, 52', thereby causing the front leg assembly and rear leg assembly to move away from one another. Once platform 35 comes to rest on support member 30 (or alternative support member(s), or, alternatively, if a support member is not used, when couplers 55, 57 reach the end of channels 50, 50' or 52, 52'), safety bar 70 is lifted, whereby guardrail rotates about the axis created by nonpermanent fasteners 160 toward the front leg assembly. Once guardrail 60 is in its active position (i.e., when the end of channels 85, 85' abut stops 75), as shown in FIG. 1, stops 75 are advanced into receivers 87, 87' to lock learning tower 5 in the open position and guardrail 60 in the active position.

In an embodiment, wherein apertures 40, 40', 42, 42' are disposed through legs 20, 20' and channels 50, 50', 52, 52' are disposed in/through legs 10, 10', with stops 75 retracted from receivers 89, 89' (so that the distal end of stops 75 are disposed within channels 85, 85'), the user must exert downward force on the rear edge of platform 35 to transition learning tower 5 from the closed position to the open position. As platform 35 is lowered, it rotates about the axis created by releasable fasteners 45 (or spring-loaded bolt latches 37) toward the rear leg assembly. As platform 35 rotates downward, couplers 55, 57 slide within channels 50, 50' or 52, 52', causing the rear leg assembly and the front leg assembly to move away from one another. Once platform 35 comes to rest on support member 30 (or alternative support member(s), or, alternatively, if a support member is not used, when coupler(s) 55, 57 reach the end of channels 50, 50' or 52, 52'), guardrail 60 is deployed to the active position as described above.

In addition to being collapsible, learning tower 5 is configured to transition between a lower position and an upper position. In the lower position, platform 35 is coupled to legs 10, 10' (via apertures 40, 40') and legs 20, 20' (via channels 50, 50'). Additionally, when support member 30 is used, support member is coupled to legs 20, 20' at mortises 110, 110'.

To transition from the lower position to the upper position, platform 35 is decoupled from legs 10, 10' at apertures 40, 40'. Next, platform 35 is decoupled from legs 20, 20' at channels 50, 50'. Next, platform 35 is recoupled to legs 20, 20' (via channels 52, 52'). Finally, platform 35 is recoupled to legs 10, 10' (via apertures 42, 42'). Additionally, when support member 30 is used, support member is decoupled from legs 20, 20' at mortises 110, 110' and recoupled to legs 20, 20' (at mortises 112, 112').

While the description and drawings only contemplate two vertical positions, i.e., a lower position and an upper position, it should be understood that the embodiments shown and described are for illustrative purposes and are not intended to limit the present invention. Additional vertical positions could be added by adding additional channels in legs 20, 20' and a corresponding number of additional apertures in legs 10, 10' (or additional channels in legs 10, 10' and a corresponding number of additional apertures in legs 20, 20' in embodiments where the design is reversed, as detailed herein).

The invention has been described herein using specific embodiments for the purposes of illustration only. It will be readily apparent to one of ordinary skill in the art, however, that the principles of the invention can be embodied in other ways to achieve the same purposes without departing from the scope of the invention. Likewise, it will be readily apparent that the features, functions, elements, and/or steps of the present invention disclosed herein can be used in any combination or order to produce various embodiments of the present invention. This application is intended to cover any adaptations or variations of the embodiments discussed herein. The invention should not be regarded as being limited in scope to the specific embodiments disclosed herein, but instead as being fully commensurate in scope with the following claims.

I claim:

1. A learning tower comprising:

a. a frame comprising:

I. A rear leg assembly; and

II. A front leg assembly rotatably coupled to the rear leg assembly, wherein the learning tower is configured to transition between an open position and a closed position; and b. a platform, wherein a first end and a second end of the platform are removably coupled to the frame, wherein the platform is configured to transition between a lower position and an upper position, wherein, in the lower position, the first end of the platform is rotatably coupled to the frame at a lower mounting position and the second end of the platform is slidably coupled to the frame through engagement with a first pair of channels, wherein, in the upper position, the first end of the platform is rotatably coupled to the frame at an upper mounting position and the second end of the platform is slidably coupled to the frame through engagement with a second pair of channels, wherein the first end of the platform is coupled to the rear leg assembly, wherein the second end of the of the platform is coupled to the front leg assembly, wherein one or more support members are removably coupled to the front leg assembly, wherein the one or more support members are configured to support the second end of the platform when the learning tower is in the open position, wherein, when the platform is in the lower position, the one or more support members are disposed at a first mounting position, wherein, when the platform is in the upper position, the one or more support members are disposed at a second mounting position.

2. The learning tower of claim 1, wherein application of upward force on the second end of the platform is configured to transition the learning tower from the open position to the closed position, wherein application of downward force on the second end of the platform is configured to transition the learning tower from the closed position to the open position.

3. The learning tower of claim 1, further comprising a guardrail rotatably coupled to the frame, wherein the guardrail is configured to transition between a storage position and an active position.

4. The learning tower of claim 3, wherein the guardrail rotates about a common axis of rotation with the front leg assembly and the rear leg assembly.

5. The learning tower of claim 3, wherein a first leg of the frame includes a C-shaped channel, wherein a stop is configured to pass through an aperture in the guardrail and into the C-shaped channel, wherein a portion of the stop is configured to travel within the C-shaped channel as the guardrail is rotated.

6. The learning tower of claim 5, wherein a second leg of the frame includes a first receiver, wherein the C-shaped channel includes a first aperture that extends through the first leg, wherein, when the learning tower is in the open position and the guardrail is in the active position, the first aperture aligns with the guardrail aperture and the first receiver, wherein the stop is configured to pass into the first receiver to temporarily lock the learning tower in the open position and the guardrail in the active position.

7. The learning tower of claim 6, wherein the second leg further includes a second receiver, wherein the C-shaped channel further includes a second aperture that extends through the first leg, wherein, when the learning tower is in the closed position and the guardrail is in the storage position, the second aperture aligns with the guardrail aperture and the second receiver, wherein the stop is configured to pass into the second receiver to temporarily lock the learning tower in the closed position and the guardrail in the storage position.

8. The learning tower of claim 5, wherein a second leg of the frame includes a receiver, wherein the C-shaped channel includes an aperture that extends through the first leg, wherein, when the learning tower is in the closed position and the guardrail is in the storage position, the C-shaped channel aperture aligns with the guardrail aperture and the receiver, wherein the stop is configured to pass into the receiver to temporarily lock the learning tower in the closed position and the guardrail in the storage position.

9. The learning tower of claim 1, wherein each channel of the first pair of channels is interconnected with a channel of the second pair of channels.

10. The learning tower of claim 1, wherein an upper terminal portion of each channel of the second pair of channels is curved.

11. A learning tower comprising:

a. a frame comprising:

I. a rear leg assembly; and

II. a front leg assembly rotatably coupled to the rear leg assembly, wherein the learning tower is configured to transition between an open position and a closed position; and b. a platform, wherein a first end and a second end of the platform are removably coupled to the frame, wherein the platform is configured to transition between a lower position and an upper position, wherein, in the lower position, the first end of the platform is rotatably coupled to the frame at a lower mounting position and the second end of the platform is slidably coupled to the frame through engagement with a first pair of channels, wherein, in the upper position, the first end of the platform is rotatably coupled to the frame at an upper mounting position and the second end of the platform is slidably coupled to the frame through engagement with a second pair of channels, wherein the first end of the platform is coupled to the front leg assembly, wherein the second end of the of the platform is coupled to the rear leg assembly, wherein one or more support members are removably coupled to the rear leg assembly, wherein the one or more support members are configured to support the first end of the platform when the learning tower is in the open position, wherein, when the platform is in the lower position, the one or more support members are disposed at a first mounting position, wherein, when the platform is in the upper position, the one or more support members are disposed at a second mounting position.

* * * * *